United States Patent [19]

Matumoto et al.

[11] 4,435,151

[45] Mar. 6, 1984

[54] FUEL SUPPLY CONTROL SYSTEM

[75] Inventors: Michiaki Matumoto, Tokyo; Hironori Etou, Kashiwa; Hidekazu Nakamoto, Tokyo, all of Japan

[73] Assignee: Hitachi, Ltd., Tokyo, Japan

[21] Appl. No.: 266,138

[22] Filed: May 22, 1981

[30] Foreign Application Priority Data

May 26, 1980 [JP] Japan ..... 55-68976

[51] Int. Cl.[3] ..... F23N 1/02

[52] U.S. Cl. ..... 431/90; 137/99; 137/500

[58] Field of Search ..... 431/12, 90, 19; 137/99, 137/100, 500; 251/335 A; 236/15 BD, 15 C; 239/61, 62

[56] References Cited

U.S. PATENT DOCUMENTS

| | | | |
|---|---|---|---|
| 2,212,606 | 8/1940 | Klinker | 431/90 |
| 2,311,061 | 2/1943 | Lutherer | 431/90 X |
| 3,101,897 | 8/1963 | Vaughn | 431/90 X |
| 3,493,005 | 2/1970 | Kakegawa | 137/100 |
| 3,827,849 | 8/1974 | Nelson | 431/90 |

FOREIGN PATENT DOCUMENTS

| | | | |
|---|---|---|---|
| 2708858 | 9/1978 | Fed. Rep. of Germany | 431/90 |
| 1126933 | 12/1956 | France | 431/90 |
| 54-89537 | 6/1979 | Japan . | |

*Primary Examiner*—Samuel Scott
*Assistant Examiner*—Randall L. Green
*Attorney, Agent, or Firm*—Antonelli, Terry & Wands

[57] ABSTRACT

A fuel supply control system including a major area diaphragm and a minor area diaphragm defining therebetween a reference pressure chamber. A control pressure chamber is located adjacent the major area diaphragm on a side thereof opposite to the reference pressure chamber and a controlled pressure chamber is located adjacent the minor area diaphragm on a side thereof opposite to the reference pressure chamber. A valve is connected to the diaphragms for regulating the opening of an orifice of a fuel passage and the controlled pressure chamber serves as a chamber of the fuel passage. The control pressure chamber is connected to a combustion air supply passage system, and the reference pressure chamber is connected to a portion of an air supply and exhaust passage system, in which the pressure is lower than the pressure in the combustion air supply passage system.

3 Claims, 2 Drawing Figures

FUEL SUPPLY CONTROL SYSTEM

BACKGROUND OF THE INVENTION

This invention relates to fuel supply control systems suitable for use with combustors of water heaters, etc., and more particularly it is concerned with a fuel supply control system for effecting proportional combustion.

To enable combustion to take place in good condition, it is necessary to keep constant the fuel-air ratio of fuel-air mixtures. Particularly in combustors for effecting proportional combustion, it is essential that the fuel-air ratio be kept constant through the entire range of changes in the amount of heat of combustion which show variations in a wide range.

This type of combustion apparatus is shown, for example, in Japanese Laid-Open Utility Model Publication No. 89537/1979. The fuel supply control system disclosed in this Publication comprises a diaphragm of a minor area and a diaphragm of a major area, three chambers separated from one another by the two diaphragms, and a valve connected to the two diaphragms for controlling the opening of a fuel passage, the chamber adjacent the diaphragm of the minor area serving as a chamber of the fuel passage upstream of the valve, the chamber between the two diaphragms opening in a chamber downstream of the valve and the chamber adjacent the diaphragm of the major diameter being connected to a combustion air supply passage system.

The control system of the aforesaid construction has the disadvantage that the fuel-air ratio of the mixtures is easily influenced by errors in fabrication and assembly of the system and the parts located in its vicinity.

SUMMARY OF THE INVENTION

This invention has been developed for the purpose of obviating the aforesaid disadvantage of the prior art. Accordingly, an object of the invention is to provide a fuel supply control system capable of maintaining with high accuracy the fuel-air ratio of the fuel-air mixture at a predetermined desirable level.

One of the characteristic features of the invention resides in that the chamber defined between the two diaphragms or large and small diaphragms is connected to a portion of an air supply and exhaust passage system of the pressure lower than that of the chamber adjacent the diaphragm of a major or large area.

DESCRIPTION OF THE PREFERRED EMBODIMENTS

One embodiment of the invention in the form of a liquid fuel supply control system will now be described by referring to FIGS. 1 and 2.

Figure 1:
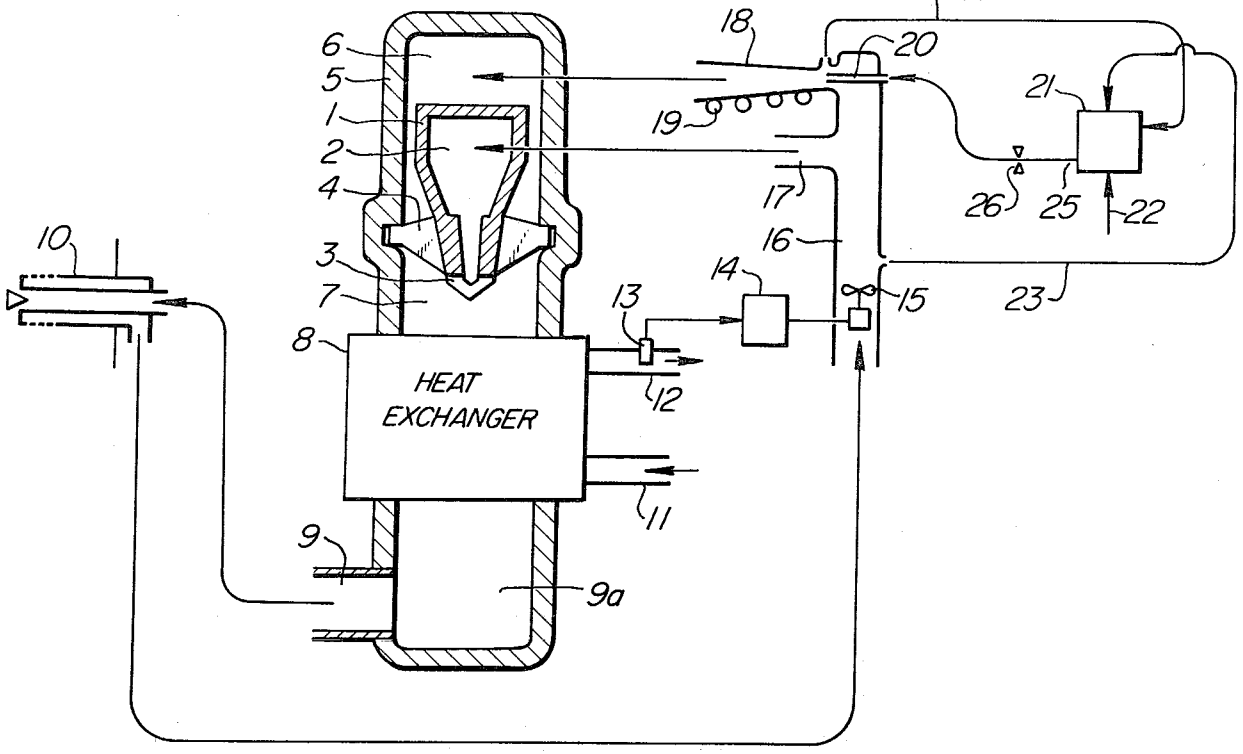
FIG. 1 a view showing the construction of the fuel supply control system in accordance with an embodiment of the invention.

In FIG. 1, numeral 1 designates a burner capable of carrying out proportional combustion. The burner 1 which extends straightly comprises a secondary air passage 2 located in the central portion and having a plurality of secondary air ports 3 in the form of slits disposed in side-by-side relation at its bottom end. A plurality of slit-like flame ports 4 are located on opposite sides of the secondary air passage 2 in side-by-side relation, and a fuel-air premix passage 6 is defined between an outer side of the burner 1 and a wall 5. As a fuel-air mixture flows out of the flame ports 4, primary combustion takes place in a combustion chamber 7, and complete combustion takes place with secondary air being supplied through the secondary air ports 3. The combustion gas is discharged through an exhaust cylinder 9 after giving off heat in a heat exchanger 8. Numeral 10 designates an air supply and exhaust cylinder.

Water introduced into the heat exchanger 8 through a water supply port 11 is heated by the heat given off by the combustion gas and flows out through a hot water dispensing port 12 as hot water. The temperature of the hot water is sensed by a temperature sensor 13, and the number of revolutions of a blower 15 for supplying combustion air is controlled by an RPM controller 14. That is, when the temperature of the hot water is higher than a predetermined value, the number of revolutions is reduced. Air for combustion is supplied through an air supply passage 16. A portion of the air is supplied through a secondary air passage 17 to the secondary air passage 2 of the burner 1, and the rest of the air is supplied to a venturi-like evaporator 18 which is heated to a predetermined temperature by a heater 19. A fuel supply nozzle 20 opens in a throat of the venturi.

Numeral 21 designates constant fuel-air ratio means for controlling fuel supplied through a fuel inlet 22 as by a fuel pump to keep the fuel volume at a level commensurate with the air volume for combustion. The constant fuel-air ratio means 21 is maintained in communication with the fuel nozzle 20 through an orifice 26 and a fuel outlet 25. To provide a fuel volume commensurate with the air volume, the pressure in the air supply passage 16 is supplied through a pressure transmitting pipe 23 to the constant fuel-air ratio means 21 which also receives through another pressure transmitting pipe 24 a supply of pressure from a portion of an air supply and exhaust passage system including the throat of the venturi, an exhaust accumulating chamber 9*a* and exhaust cylinder 9 that has a lower pressure than the air supply passage 16.

Figure 2:
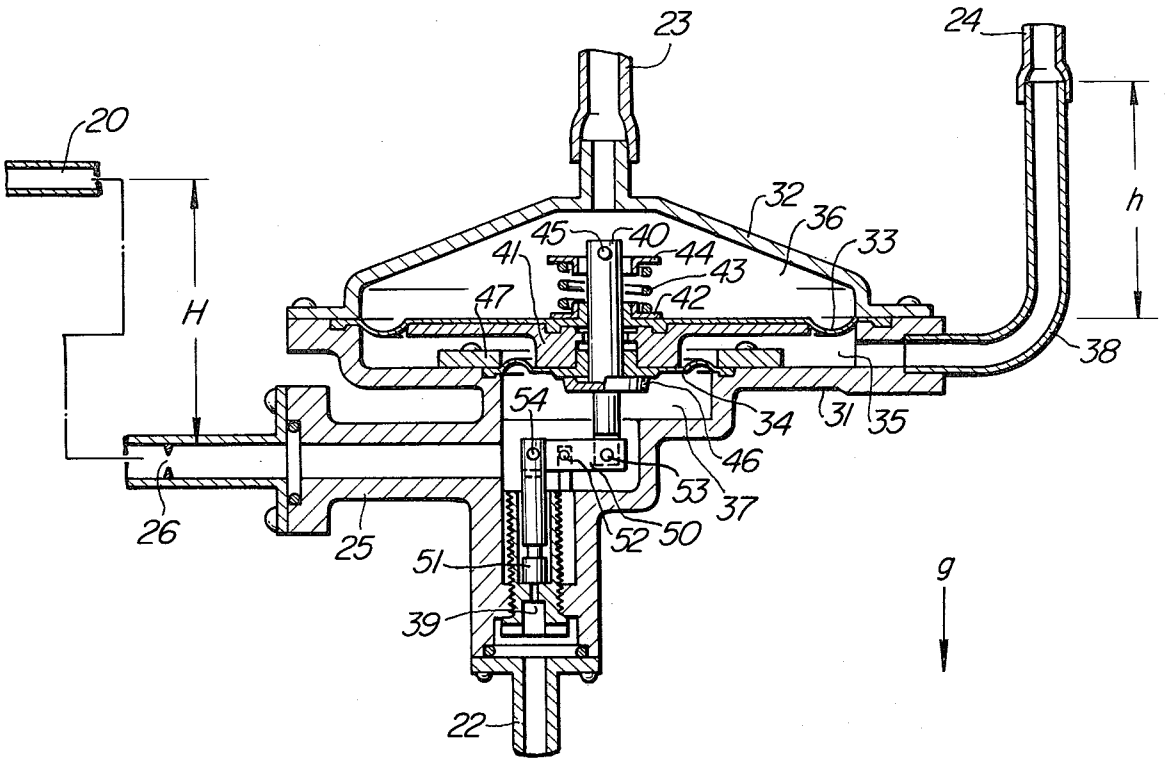
FIG. 2 is a vertical sectional view showing an exemplary construction of constant fuel-air ratio means used in the fuel supply control system.

FIG. 2 shows in detail the construction of the constant fuel-air ratio means 21, in which g indicates the direction of the gravitational force. The constant fuel-air ratio means 21 comprises a main body 31, 32 having a diaphragm 33 of a major or large diameter and a diaphragm 34 of a minor or small diameter formed of flexible material hermetically fixed at their outer peripheries in the main body 31, 32, to define therein a reference pressure chamber 35 defined between the two diaphragms 33 and 34, a control pressure chamber 36 located adjacent the major diameter diaphragm 33 on a side thereof opposite the reference pressure chamber 35 and a controlled pressure chamber 37 located adjacent the minor diameter diaphragm 34 on a side thereof opposite the reference pressure chamber 35.

The reference pressure chamber 35 is connected through a riser pipe 38 and the pressure transmitting pipe 24 to the low pressure section of the air supply and exhaust passage system, with the riser pipe 38 rising a predetermined amount h as subsequently to be described. The control pressure chamber 36 is connected to the high pressure section through the pressure transmitting pipe 23, and the controlled pressure chamber 37 is connected through an inlet orifice 39 to the fuel inlet 22 and through the fuel output 25 and orifice 26 to the fuel nozzle 20. The fuel nozzle 20 opens in a position which is higher than the liquid level of the controlled pressure chamber 37 by a distance H. A portion of the controlled pressure chamber 37 above the fuel outlet 25 is full of air. A portion of the controlled pressure chamber 37 downstream of the inlet orifice 26 is a secondary pressure chamber for the fuel, and a portion upstream of the inlet orifice 26 is a primary pressure chamber.

The two diaphragms 33 and 34 are hermetically interconnected by a connecting rod 40. Numerals 41, 42, 43, 44 and 45 respectively designate a spacer, a seat, a coil spring, a bolster and a pin which are provided for connecting the two diaphragms 33 and 34 to the connecting rod 40 and a seat 46. Numeral 47 designates a fixed seat of the diaphragm 34.

The connecting rod 40 is connected through a link 50 to a valve 51 for opening and closing the inlet orifice 39. Numeral 52 designates a pivot, and numerals 53 and 54 are connecting pins. The distance between the connecting pin 53 and pivot 52 is equal to or larger than the distance between the pivot 52 and pin 54. The diameter of the inlet orifice 39 is sufficiently smaller than the diameter of the minor diameter diaphragm 34.

In operation, air for combustion is supplied from the air supply and exhaust cylinder 10 through operation of the blower 15. This causes the pressure Pa of the air for combustion in the air supply passage 16 to be applied to the control pressure chamber 36 and a pressure Po lower than the pressure Pa to be applied to the reference pressure chamber 35, so that the diaphragm 33 is moved downwardly to open the valve 51. This allows fuel to flow into the controlled pressure chamber 37 through the fuel inlet 22 to raise the pressure P2 of the controlled pressure chamber 37. A rise in the pressure P2 of the controlled pressure chamber 37 moves the diaphragm 34 upwardly to close the valve 51. Thus the pressure P2 of the controlled pressure chamber 37 is kept at a level at which the force exerted on the diaphragm 33 by the pressure differential Pa−Po and the force exerted on the diaphragm 34 by the pressure differential P2−Po balance. At this time, since the diaphragm 33 has an area A1 larger than an area A2 of the diaphragm 34, the pressure P2 becomes higher than the pressure Pa. The fuel is supplied by this pressure P2 and the flow rate is controlled by the orifice 26, so that the fuel of the controlled flow rate is supplied through the fuel nozzle 20 to the evaporator 18. At this time, primary air is supplied simultaneously from the blower 15, to atomize the fuel supplied to the evaporator 18.

Since the evaporator 18 is heated by the electric heater to a temperature of about 250° C., the fuel in atomized particles is vaporized and mixed with the primary air. The fuel-air mixture is passed through the fuel-air mixture passage 6 and issued through the flame ports 4 of the burner 1, so that primary combustion takes place. Secondary air is supplied through the secondary air passages 17 and 2 and the secondary air ports 3 to enable complete combustion to take place. The combustion gas is passed through the heat exchanger 8, and vented as exhaust gas through the exhaust cylinder 9 and air supply and exhaust cylinder 10.

Water flows through the heat exchanger 8. When the hot water flowing out of the hot water dispensing port 12 rises above a predetermined value in temperature, the temperature sensor 13 senses this temperature and issues a signal which is supplied to the RPM controller 14 to reduce the voltage impressed on the motor of the blower 15, to thereby reduce the number of revolutions thereof to reduce the volume of air for combustion. A drop in the volume of air for combustion causes a drop in the pressure Pa applied to the control pressure chamber 36, so that the valve 51 closes and the pressure P2 of the controlled pressure chamber 37 also drops. This results in a reduction in the flow rate of fuel flowing through the fuel nozzle 20. Thus the fuel volume can be varied while the air and fuel can be kept at constant proportions in volume and the fuel-air mixture can be burnt in good condition. At the same time, the temperature of the hot water flowing through the hot water dispensing port 12 can be kept constant at all times.

The relation between the fuel volume and the air volume will be described hereunder by using formulae.

The relationship between the upwardly directed force exerted on the constant fuel-air ratio means 21 and the downwardly directed force exerted thereon are expressed by equation (1). Consequently the pressure P2 of the controlled pressure chamber 37 can be indicated by equation (2), and the fuel volume Qf can be indicated by formula (3).

$$A_1Pa + A_2P_0 + A_oP_1r_1 + W_0 = A_1P_0 + A_2P_2 + A_oP_2r_1 \quad (1)$$

$$P_2 = \frac{A_1}{A_2 + A_or_1}Pa - \frac{A_1 - A_2}{A_2 + A_or_1}P_0 + \frac{A_or_1P_1 + W_0}{A_2 + A_or_1} \quad (2)$$

$$Qf \propto \sqrt{\left[\frac{A_1}{A_2 + A_or_1} - C_1\left(\frac{A_1 - A_2}{A_2 + A_or_1}\right) - C_2\right]Pa + \sqrt{\frac{A_or_1P_1}{A_2 + A_or_1} - \gamma H}} \quad (3)$$

where $A_1$: effective pressure receiving area of diaphragm 33.
$A_2$: effective pressure receiving area of diaphragm 34.
$A_o$: area of inlet orifice 39.
Pa: pressure of control pressure chamer 36.
Po: pressure of reference pressure chamber 35.
P1: pressure of primary pressure chamber.
P2: pressure of controlled pressure chamber 37.
$C_1$: Po/Pa . . . constant sufficiently smaller than 1.
$C_2$: Pn/Pa . . . constant sufficiently smaller than 1.
Pn: pressure in the vicinity of fuel nozzle 20.
Wo: weight of the movable parts.
$r_1$: distance from pivot 52 to pin 54/distance from pivot 52 to pin 53 . . . which is constant, $r_1 \leqq 1$.
$\gamma$: specific weight of fuel
H: height from the liquid level of controlled pressure chamber 37 to fuel nozzle 20.

The air volume Qa can be expressed by the following formula:

$$Qa \propto \sqrt{Pa} \quad (4)$$

Thus, from formulae (3) and (4), the ratio of the fuel volume supplied to the burner 1 to the air volume supplied thereto can be expressed by the following formula:

$$\frac{Qf}{Qa} \propto \quad (5)$$

-continued $$\sqrt{1+\frac{\Delta P}{\left[\frac{A_1}{A_2+A_o r_1}-C_1\left(\frac{A_1-A_2}{A_2+A_o r_1}\right)-C_2\right]Pa}}$$

$$\Delta P=\frac{A_o r_1 P_1+W_0}{A_2+A_o r_1}-\gamma H$$

Thus if the value of H is set such that $\Delta P=0$, the fuel volume will change with variations in the air volume while the proportions of the fuel and the air are kept constant, so that combustion can be sustained in good condition from a high combustion state to a low combustion state.

No problem would arise if $\Delta P=0$ in equation (5). However, there is the case where the relation $\Delta P=0$ cannot be established because of fabrication errors and the condition in which the system is installed. In this case, it is necessary to enable combustion to take place satisfactorily by minimizing changes in the ratio Qf/Qa. To this end, one would have to increase A1/A2 and reduce C1 and C2 in equation (4). Thus in the invention, the diaphragm 33 has a larger area than the diaphragm 34 and Po is the pressure prevailing in a section (throat of the evaporator 20, exhaust accumulating chamber 9a, exhaust cylinder 9, etc.) which is sufficiently lower than Pa. This enables changes in the ratio Qf/Qa to be minimized at low cost.

Since A2>Ao, and r1≦1, the pressure P2 at which the fuel is supplied is substantially A1/A2 times as high as the pressure Pa at which the air is supplied, as can be clearly seen in equation (2). This increases the pressure differential between the fuel supply pressure P2 and the air pressure Pn, thereby reducing the rate of change in the proportions of the supplied fuel and supplied air.

In gas governors, a spring is mounted to cancel out the weight Wo of movable parts, etc. However, when the fuel is kerosene, its specific gravity $\gamma$ is higher than that of gas. Thus, in equation (5), the term of $\Delta P$ can be rendered $\Delta P=0$ with the mounting position H of the constant fuel-air ratio means 21 relative to the fuel nozzle 20, and hence the cost of production of the constant fuel-air ratio means 21 can be minimized in relation to the position of mounting H. The mounting position H is related to other factors also, and is determined by taking all of the factors into consideration.

This arrangement also offers the advantage that the fuel nozzle 20 is higher in position than the fuel outlet 25, thereby avoiding the risks of air being collected in the fuel supply pipe when no combustion takes place.

As can be clearly seen in equation (5), the influence of the inlet pressure P1 can be minimized by reducing the ratio Ao/A2 anr r1.

When combustion equipment is actually installed, the distance between the combustion equipment and air supply and exhaust cylinder 10 may vary depending on installation condition, and the condition of external air to which the air supply and exhaust cylinder 10 is exposed may also vary, resulting in a variation in the air volume (air pressure Pa). It is necessary to keep constant the value Qf/Qa, even if air pressure Pa is varied to external causes. In the invention, the atmospheric pressure is not used but the pressure in a portion of the air supply and exhaust passage system extending from the air supply port of the air supply and exhaust cylinder 10 to its exhaust port is used as the pressure Po of the reference pressure chamber 35. As a result, the pressure Po is varied in conjunction with a change in the pressure Pa, thereby rendering the value of C1 in equation (5) substantially constant. Also, since the pressure Pn of C2 is varied in conjunction with a variation in the pressure Pa, the value of C2 can be kept substantially constant. Consequently the value in the brackets [ ] in the $\sqrt{}$ in equation (5) is not largely susceptible to the aforesaid external causes. Thus the Qf will vary substantially in conjunction with a variation in the pressure Pa and the change in the ratio Qf/Qa can be minimized.

When the pressure Po is the pressure in the throat of the venturi in the evaporator 18, the change in the ratio Qf/Qa in relation to $\Delta P$ can be reduced.

Since the pressure transmitting pipe 24 communicating with the reference pressure chamber 35 is partly constituted by the riser pipe 38 which has a height larger than 1.2 times the air pressure Pa (Pa/0.8≈1.2 Pa with 0.8 being the specific gravity of kerosene), the liquid fuel would be collected in the riser pipe 38 to press the diaphragm 33 upwardly in the event of the rupture of the diaphragm 34, and hence the valve 51 would be moved downwardly to close the inlet orifice 39. Thus, the combustion is interrupted. Also fuel leak through the pressure transmitting pipe 24 could be avoided.

The presence of an air sump above the controlled pressure chamber 37 prevents the diaphragm 34 from contacting with the liquid fuel, thereby prolonging the service life of the diaphragm 34 and reducing the cost of the entire system. The air sump can be reduced in size by providing the controlled pressure chamber 37 with an air venting valve at its side.

The constant fuel-air ratio means 21 of the aforesaid embodiment may be placed upside down so that the gravitational force may be acted in the reversed direction. In this case, the constant fuel-air ratio means 21 is placed higher by a predetermined amount H above the fuel nozzle 20. Such placement becomes unnecessary if a spring for establishing $\Delta P=0$ is provided on the side of the diaphragm 33 of the major diameter. When it is desired to prevent fuel leaks which may be caused by the rupture of the diaphragm 34, a riser pipe extending upwardly may be used.

It is possible to obtain a structure that the link 50 is dispensed with or the diaphragm 34 is exposed to the primary pressure. The air pressure in the control pressure chamber 36 may be an increased pressure produced by raising the pressure of air in the combustion air supply passage 16 by using an additional blower or other suitable means.

What is claimed is:

1. A fuel supply control system comprising:

a first diaphragm;

a first chamber located adjacent to said diaphragm on one side thereof;

a valve port of a liquid fuel passage connected to a liquid fuel source on an upstream side thereof and to said chamber on a downstream side thereof;

a liquid fuel supply pipe connected to said chamber for supplying the liquid fuel from said chamber to a combustor;

a second diaphragm of a larger effective area than that of said first diaphragm and located on a side of said first diaphragm opposite to said first chamber;

a valve connected to said diaphragms for regulating the opening of said valve port;

a second chamber located between said diaphragms;

a riser pipe connected to said second chamber at one end and to a portion of an air supply and exhaust passage system at the other end;

a third chamber located adjacent to said second diaphragm on a side thereof opposite to said second chamber and connected to a combustion air supply passage system in which the pressure is higher than that in said air supply and exhaust passage system; and the vertical distance H between an end of said liquid fuel supply pipe from which the liquid fuel is directed to said combustor and said chamber has a value commensurate with the weight or the like of said diaphragm and other movable parts in accordance with the relationship:

$$H\gamma = \frac{A_0 r_1 P_1 + W_0}{A_2 + A_0 r_1},$$

where $\gamma$=specific gravity of the liquid; $A_0$=area of the valve port; $r_1$=a valve constant $\leqq 1$; $P_1$=pressure of said end of the liquid fuel supply pipe; $A_2$=effective pressure receiving area of said diaphragm; and $W_0$=weight of movable parts.

2. A fuel supply control system according to claim 1, wherein said first chamber is located below said first diaphragm, and an opening into a lateral side of said first chamber below said first diaphragm, to which said liquid fuel supply pipe is connected, is located below said diaphragm.

3. A fuel supply control system according to claim 6:

said riser pipe being connected to said first chamber and having a vertical rise of an amount greater than the value obtained by dividing the pressure in said combustion air supply passage system by the specific gravity of a liquid fuel supplied by said liquid fuel supply source; and said riser pipe having a top end connected to a portion of an air supply and exhaust passage system in which the pressure is lower than the pressure in said combustion air supply passage system, and said valve port being adapted to be closed by said valve, upon a rupturing of said first diaphragm in use, under the action of liquid fuel collected in said riser pipe.

* * * * *